US007819927B2

(12) United States Patent
Greenspoon

(10) Patent No.: US 7,819,927 B2
(45) Date of Patent: Oct. 26, 2010

(54) SYNTHETIC-RICH FABRICS

(75) Inventor: Frederick M. Greenspoon, 731 W. Wynnewood Rd., #20, Ardmore, PA (US) 19003

(73) Assignee: Frederick M. Greenspoon, Ardmore, PA (US)

( * ) Notice: Subject to any disclaimer, the term of this patent is extended or adjusted under 35 U.S.C. 154(b) by 323 days.

(21) Appl. No.: 11/814,529

(22) PCT Filed: Jan. 24, 2006

(86) PCT No.: PCT/US2006/002468

§ 371 (c)(1),
(2), (4) Date: Jul. 23, 2007

(87) PCT Pub. No.: WO2006/079075

PCT Pub. Date: Jul. 27, 2006

(65) Prior Publication Data

US 2008/0134444 A1 Jun. 12, 2008

Related U.S. Application Data

(60) Provisional application No. 60/647,272, filed on Jan. 24, 2005.

(51) Int. Cl.
*D06M 13/00* (2006.01)
*B32B 27/04* (2006.01)

(52) U.S. Cl. ..... 8/115.56; 8/115.54; 442/131

(58) Field of Classification Search ..... 8/115.56; 442/131

See application file for complete search history.

(56) References Cited

U.S. PATENT DOCUMENTS

| | | | | |
|---|---|---|---|---|
| 4,164,392 | A | 8/1979 | Hauser et al. | |
| 4,537,227 | A | 8/1985 | Ballarati et al. | |
| 2004/0224587 | A1 * | 11/2004 | Hayes et al. | 442/119 |
| 2006/0101585 | A1 | 5/2006 | Hayes et al. | |

FOREIGN PATENT DOCUMENTS

| | | | |
|---|---|---|---|
| WO | 2004/067819 | A2 | 8/2004 |
| WO | 2006/079075 | A2 | 7/2006 |

OTHER PUBLICATIONS

International Search Report WO 2006/079075 (Sep. 11, 2006).
International Preliminary Report on Patentability WO 2006/079075 (Jul. 24, 2007).
Extended Search Report EP 06719364.9 (Oct. 14, 2008).
"The Complete Textile Glossary" (2001) [Anonymous] Celanese Acetate LLC.
"The Greening of Technology" [Anonymous] Product Brochure of American Textile Specialties.

* cited by examiner

*Primary Examiner*—Harold Y Pyon
*Assistant Examiner*—Katie Hammer
(74) *Attorney, Agent, or Firm*—Edell, Shapiro & Finnan, LLC

(57) ABSTRACT

A synthetic-rich fabric (e.g., polyester, polypropylene, nylon, acrylic and elastane fibers—including lycra, spandex, etc.) useful in the manufacture of commercially launderable items is described. The fabric has many of the properties that make cotton fabrics desirable including hand feel, and wicking, but retains the best properties of synthetic fabrics, m addition, the soil release properties, pilling resistance and UV protection offered by the present items makes the fabric ideal in manufacturing apparel and non-apparel (e.g., pillow cases, bed sheets, aprons, tablecloths, napkins, etc.) items.

17 Claims, 25 Drawing Sheets

DIAGRAM I

Page 1

COMMERCIAL INDUSTRIAL LAUNDRY TEST

Item : One (1) T-Shirt, identified as: Black

Purpose : Dimensional Stability, AATCC 96 1C, A low
Skewness, AATCC 179
General Appearance, Visual
Smoothness Appearance, AATCC 124
Smoothness Seams, AATCC 88B
Color Change, Gray Scale for Color Change
Pilling, After 5 Industrial Laundering Cycles

| Test | | Results |
|---|---|---|
| **Dimensional Stability**<br>AATCC 96 1C A Low<br>(5 wash & dry cycles) | | |
| % Shrinkage: | Body Length | 0 |
| | Width at Chest | 0 |
| **Skewness (Garment Twist)***<br>AATCC Method 179<br>(Laundered using Dimensional Stability Method above) | | |
| % Change | | 0.0 |

*A negative percent change indicates skewness to the right. A positive percent change indicates skewness to the left.

FIGURE 1A

DIAGRAM I

Page 2

| | |
|---|---|
| **General Appearance** | |
| Visual | Good overall appearance |
| **Smoothness Apperance** | |
| AATCC 124 | Class 4-5 |
| **Smoothness of Seams** | |
| AATCC 88B | Class 5 |
| **Color Change** | |
| After 5 industrial cycles | Class 4-5 |
| **Pilling** | |
| After 5 industrial cycles | Class 4 |

Notes

ASTM D 3512 Photographic Standards for Pilling used to evaluate pilling samples.

Class 5 = No pilling
Class 4 = Slight pilling
Class 3 = Moderate pilling
Class 2 = Severe pilling
Class 1 = Very severe pilling AATCC Gray Scale for Color Change used to evaluate colorfastness to laundering.

Class 5 = No color change
Class 4 = Slight color change
Class 3 = Moderate color change
Class 2 = Severe color change
Class 1 = Very severe change AATCC Fabric Smoothness Replicas used to evaluate fabric appearance.

Class 5 = Very smooth, pressed, finished appearance
Class 4 = Smooth finished appearance
Class 2 = Rumpled, obviously wrinkled appearance
Class 1 = Crumpled, creased and severely wrinkled appearance AATCC Seam Smoothness Replicas used to evaluate seam appearance.

Class 5 = Very smooth, pressed, finished appearance
Class 4 = Smooth finished appearance
Class 3 = Mussed, nonpressed appearance
Class 2 = Rumpled, obviously wrinkled appearance
Class 1 = Crumpled, creased and severely wrinkled appearance

FIGURE 1B

DIAGRAM II

AATCC 96 1C

Dimensional Stability:

| Wash Cycle | T-Shirts | | |
|---|---|---|---|
| | Length | Chest | Sleeve |
| 0 Wash | 29.00 | 22.00 | 8.00 |
| 10 Wash | 29.00 | 22.00 | 8.00 |
| 20 Wash | 29.00 | 22.00 | 8.00 |
| 30 Wash | 29.00 | 22.00 | 8.00 |
| 40 Wash | 29.00 | 22.00 | 8.00 |
| Change (0 vs 40) | 0 | 0 | 0 |

DIAGRAM III

Item : One (1) sample fabric identified as: Lot 8099, Piece 23404

Purpose : Colorfastness after Repeated Home Launderings

| Test | Results |
|---|---|
| **Colorfastness after Repeated Home Launderings** | **Rating after 101 Launderings** |
| Machine Wash (105° F)<br>Permanent Press Cycle<br>Tumble Dry Permanent Press | Class 4-5 |

AATCC Gray Scale for Color Change used to evaluate change of test specimen.

Class 5 = No color change
Class 4 = Slight color change
Class 3 = Moderate color change
Class 2 = Severe color change
Class 1 =Very severe color change

FIGURE 3

STAIN TEST

Item : One (1) sample fabric identified as: Lot 8099, Piece 23404

Purpose : Soil Release: Oily Stain Method, AATCC 130

| Test | | Results | | | |
|---|---|---|---|---|---|
| **Soil Release: Oily Stain*** | | Number of Laundering Cycles | | | |
| AATCC 130, Machine Wash III (105° F)<br>Permanent Press Cycle<br>Tumble Dry Permanent Press | Original | 25 | 50 | 75 | 101 |
| Hamburger Grease | 5 | 5 | 5 | 4.5 | 4.5 |
| Mustard | 5 | 5 | 4.5 | 4.5 | 4.5 |
| Pepperoni Grease - Domino's | 4.5 | 4.5 | 4.5 | 4.5 | 4.5 |
| Pizza Sauce - Domino's | 5 | 5 | 5 | 4.5 | 4.5 |
| Butter Sauce - Domino's | 5 | 4.5 | 4.5 | 4.5 | 4.5 |
| Corn Oil (after 101 cycles only) | -- | -- | -- | -- | 4.5 |

*Staining reagents and wash cycle differ from AATCC Test Method.

Stain Release Replica used to evaluate stain release samples.
Grade 5 represents the best stain removal and Grade 1 the poorest stain removal.

FIGURE-4A

STAIN TEST

Item : One (1) sample fabric identified as:
Style # 8013
Description: DOUBLE KNIT TN-5.9

Purpose : Soil Release: Oily Stain Release Method, AATCC 130

| Test | Results | | |
|---|---|---|---|
| **Soil Release: Oily Stain*** | Number of Laundering Cycles | | |
| **AATCC 130, Machine Wash III (105° F)** | | | |
| **Permanent Press Cycle** | | | |
| **Tumble Dry Permanent Press** | Original | 25 | 50 |
| Folgers Black Coffee | 5 | 5 | 5 |
| Hamburger Grease | 5 | 5 | 5 |
| Cooking Oil From Fryer | 5 | 5 | 5 |
| Hormel Pepperoni | 5 | 4.5 | 5 |
| Delallo Italian Style Pizza Sauce | 5 | 5 | 5 |

*Staining reagents and wash cycle differ from AATCC Test Method.

Stain Release Replica used to evaluate stain release samples.
Grade 5 represents the best stain removal and Grade 1 the poorest stain removal.

FIGURE-4B

STAIN TEST

Item : One (1) sample fabric identified as:
Style # 8011
Description: WOVEN-WHITE-8.1 OZ

Purpose : Soil Release: Oily Stain Release Method, AATCC 130

| Test | Results | | |
|---|---|---|---|
| Soil Release: Oily Stain* | Number of Laundering Cycles | | |
| AATCC 130, Machine Wash III (105° F) Permanent Press Cycle Tumble Dry Permanent Press | Original | 25 | 50 |
| Folgers Black Coffee | 5 | 5 | 5 |
| Hamburger Grease | 4.5 | 5 | 5 |
| Cooking Oil From Fryer | 5 | 5 | 5 |
| Hormel Pepperoni | 5 | 5 | 5 |
| Delallo Italian Style Pizza Sauce | 5 | 5 | 5 |

*Staining reagents and wash cycle differ from AATCC Test Method.

Stain Release Replica used to evaluate stain release samples.
Grade 5 represents the best stain removal and Grade 1 the poorest stain removal.

FIGURE-4C

STAIN TEST

Item : One (1) sample fabric identified as:
Style # 8924
Description: 3-END FLEECE YELLOW-10-75 OZ

Purpose : Soil Release: Oily Stain Release Method, AATCC 130

| Test | Results | | |
|---|---|---|---|
| | Number of Laundering Cycles | | |
| **Soil Release: Oily Stain*** **AATCC 130, Machine Wash III (105° F)** **Permanent Press Cycle** **Tumble Dry Permanent Press** | Original | 25 | 50 |
| Folgers Black Coffee | 5 | 5 | 5 |
| Hamburger Grease | 5 | 5 | 5 |
| Cooking Oil From Fryer | 5 | 5 | 5 |
| Hormel Pepperoni | 5 | 5 | 5 |
| Delallo Italian Style Pizza Sauce | 5 | 5 | 5 |

*Staining reagents and wash cycle differ from AATCC Test Method.

Stain Release Replica used to evaluate stain release samples.
Grade 5 represents the best stain removal and Grade 1 the poorest stain removal.

FIGURE-4D

UV PROTECTION FACTOR TEST

Item: One (1) sample fabric identified as: (see below)

Purpose : UV Protection Factor, AATCC 183-2000

| Test | Results | Results |
|---|---|---|
| | Yellow | Orange |
| UV Protection Factor | Jersey | Jersey |
| AATCC 183-2000 | 6.3 OZ | 6.4 OZ |
| UVA % Block | 96.35 | 97.55 |
| UVB % Block | 98.75 | 97.70 |
| Actual UPF | 48.73 | 59.61 |
| UPF Label | 45+ | 50+ |

FIGURE-5A

UV PROTECTION FACTOR TEST

Item : One (1) sample fabric identified as:

Description: White jersey-5.5 OZ

Purpose : UV Protection Factor, AATCC 183-2000

| Test | Results | | |
|---|---|---|---|
| UV Protection Factor AATCC 183-2000 | As Received | 25 Cycles | 50 Cycles |
| UVA % Block | 89.83 | 91.15 | 91.5 |
| UVB % Block | 95.98 | 96.75 | 96.86 |
| Actual UPF | 16.09 | 18.72 | 19.05 |
| UPF Label | 15 | 15 | 15 |

FIGURE-5B

UV PROTECTION FACTOR TEST

Item : One (1) sample fabric identified as:

Description: White jersey-6.4 OZ

Purpose : UV Protection Factor, AATCC 183-2000

| Test | Results | | |
|---|---|---|---|
| **UV Protection Factor AATCC 183-2000** | **As Received** | **25 Cycles** | **50 Cycles** |
| UVA % Block | 94.68 | 95.21 | 94.88 |
| UVB % Block | 98.29 | 98.59 | 98.49 |
| Actual UPF | 32.15 | 42.33 | 39.42 |
| UPF Label | 30 | 40 | 35 |

FIGURE-5C

UV PROTECTION FACTOR TEST

Item : One (1) sample fabric identified as:

Description: White jersey-7.4 OZ

Purpose : UV Protection Factor, AATCC 183-2000

| Test | | Results | |
|---|---|---|---|
| UV Protection Factor, Dry AATCC 183-2000 | As Received | 25 Cycles | 50 Cycles |
| UVA % Block | 96.35 | 97.12 | 97.12 |
| UVB % Block | 98.78 | 99.15 | 99.13 |
| Actual UPF | 50.44 | 69.21 | 63.77 |
| UPF Label | 50 | 50 | 50 |
| UV Protection Factor, Wet AATCC 183-2000 | As Received | 25 Cycles | 50 Cycles |
| UVA % Block | 96.05 | 96.04 | 95.72 |
| UVB % Block | 99.18 | 99.29 | 99.24 |
| Actual UPF | 50.18 | 57.24 | 56.23 |
| UPF Label | 50 | 50 | 50 |

* For wet testing, specimens were immersed in distilled water at room temperature until thoroughly wetted. UPF testing was completed within 2 minutes after removal from the water.

FIGURE-5D

UV PROTECTION FACTOR TEST

Item : One (1) sample fabric identified as:

Description: White jersey-6.1 OZ

Purpose : UV Protection Factor, AATCC 183-2000

| Test | Results | | |
|---|---|---|---|
| UV Protection Factor AATCC 183-2000 | As Received | 25 Cycles | 50 Cycles |
| UVA % Block | 97.22 | 97.93 | 97.91 |
| UVB % Block | 98.43 | 98.87 | 98.86 |
| Actual UPF | 36.23 | 53.91 | 50.9 |
| UPF Label | 35 | 50 | 50 |

FIGURE-5E

UV PROTECTION FACTOR TEST

Item : One (1) sample fabric identified as:

Description: Double knit-light orange-5.9 OZ

Purpose : UV Protection Factor, AATCC 183-2000

| Test | Results | | |
|---|---|---|---|
| UV Protection Facto AATCC 183-2000 | As Received | 25 Cycles | 50 Cycles |
| UVA % Block | 92.86 | 93.83 | 94.01 |
| UVB % Block | 96.91 | 97.47 | 97.57 |
| Actual UPF | 22.75 | 27.2 | 27.42 |
| UPF Label | 20 | 25 | 25 |

FIGURE-6A

UV PROTECTION FACTOR TEST

Item : One (1) sample fabric identified as:

Description: White-woven-8.1 OZ

Purpose : UV Protection Factor, AATCC 183-2000

| Test | | Results | |
|---|---|---|---|
| UV Protection Factor AATCC 183-2000 | As Received | 25 Cycles | 50 Cycles |
| UVA % Block | 98.52 | 98.57 | 98.56 |
| UVB % Block | 99.58 | 99.63 | 99.63 |
| Actual UPF | 160.76 | 168.01 | 170.48 |
| UPF Label | 50 | 50 | 50 |

FIGURE-6B

UV PROTECTION FACTOR TEST

WHITE FABRIC PRINTED WITH DYE SUBLIMATION HEAT TRANSFER APPLICATION

One (1) sample fabric identified as: Printed Camouflage Polyester Fabric

Purpose : UV Protection Factor, AATCC 183-2000
Test Darkest Areas Only

| Test | Results | |
|---|---|---|
| | BEFORE | AFTER |
| UV Protection Factor | White-no print | Printed Camouflage Polyester Fabric |
| AATCC 183-2000 | 5.9 OZ | |
| UVA % Block | 91.98 | 94.15 |
| UVB % Block | 95.87 | 94.94 |
| Actual UPF | 17.82 | 18.3 |
| UPF Label | 15 | 15 |

Figure 7

COLORFASTNESS TO LAUNDERING

WHITE FABRIC PRINTED WITH DYE SUBLIMATION HEAT TRANSFER APPLICATION

Items : One (1) sample fabric identified as:
Printed Camouflage Polyester Fabric
White-jersey- 5.9 OZ

Purpose : Colorfastness to Laundering, AATCC 61 (Test 2A)

| Test | Results |
|---|---|
| **Colorfastness to Laundering AATCC-61,2A** | |
| **Test Specimen** | Class 5 |
| **Multifiber Test Cloth** | |
| Wool | Class 5 |
| Orlon | Class 5 |
| Polyester | Class 5 |
| Nylon | Class 4 |
| Cotton | Class 5 |
| Acetate | Class 4 |

FIGURE 8

CROCKING RESISTANCE

WHITE FABRIC PRINTED WITH DYE SUBLIMATION HEAT TRANSFER APPLICATIOI

Item: One (1) sample identified as:
Printed Sharks Polyester Fabric
White-jersey-5.9 OZ
Purpose: Crocking Resistance, AATCC 8

| Test, Unit of Measure | Results |
|---|---|
| **Crocking Resistance AATCC 8** | |
| Dry Rub | Class 5 |
| Wet Rub | Class 5 |

AATCC "Gray Scale for Staining" used to evaluate crocking squares.

Class 5 = No staining
Class 4 = Slight staining
Class 3 = Moderate staining
Class 2 = Severe staining
Class 1 = Very severe staining

Figure 9

MOISTURE VAPOR TRANSMISSION

WHITE FABRIC PRINTED WITH DYE SUBLIMATION HEAT TRANSFER APPLICATIOI

Item: One (1) sample identified as:
Printed Sharks Polyester Fabric
White-jersey-5.9 OZ
Purpose: Moisture Vapor Transmission

| **Test, Unit of Measure**<br>**Moisture Vapor Transmission**<br>**ASTM E 96, Procedure B**<br>(g/m2/24 hr) | **Results** |
|---|---|
| Initial | 1446.2 |
| | 1285.2 |
| | 1209.4 |
| Avg. | 1313.6 |
| Rating: | **Excellent** |

Figure 10

WICKING ABSORBENCY TEST

Purpose : Absorbency of Fabrics, AATCC 79-2000 Modified*

Test

AATCC 79-2000 Absorbency of Textiles, Modified*
Absorbency reported in seconds
avg. 3

| | | Results 5.5 OZ Jersey white | Results 5.9 OZ Jersey white | Results 6.4 OZ Jersey white | Results 7.4 OZ Jersey white | Results 8.1 OZ Woven white | Results 5.9 OZ Dbl Knt orange | Results 10.1 OZ Fleece yellow | Results 16.5 OZ Dbl Knt white |
|---|---|---|---|---|---|---|---|---|---|
| As Received | | 0.23 | 0.44 | 0.60 | 0.38 | NA | 1.09 | 0.37 | 0.53 |
| | | 0.41 | 0.44 | 0.28 | 0.28 | NA | 0.69 | 0.53 | 0.82 |
| | | 0.54 | 0.40 | 0.60 | 0.25 | NA | 0.88 | 0.59 | 0.63 |
| | Avg. | 0.00 | 0.00 | 0.00 | 0.00 | NA | 0.89 | 0.00 | 0.66 |
| After 50 Launderings | | 0.56 | 0.35 | 0.44 | 0.44 | 0.44 | 0.62 | 0.40 | NA |
| | | 0.34 | 0.47 | 0.28 | 0.25 | 0.60 | 0.93 | 0.54 | NA |
| | | 0.56 | 0.35 | 0.19 | 0.22 | 0.43 | 0.78 | 0.34 | NA |
| | Avg. | 0.00 | 0.00 | 0.00 | 0.00 | 0.00 | 0.78 | 0.00 | NA |

* Modifications to method per customer request:

Distilled water drop height is 1 inch.
Timer stopped at 5 seconds or at the point where the surfce of the liquid loses it specular reflectan
Average of 3 readings recorded.
Averages less than 0.5 seconds reported as 0.0 seconds.

FIGURE-11

Item : One (1) sample fabric identified as Yellow jersey-6.3 OZ

Purpose : Wicking, PTL Method 1040

Test

| **Wicking**** PTL Method 1040 Vertical Position, 3" benchmarks Time (minutes) | Length Direction | Width Direction |
|---|---|---|
| After 25 launderings | 4.1 | 3.3 |
| | 3.5 | 2.7 |
| | 3.5 | 3.7 |
| | 3.6 | 3.9 |
| | 3.9 | 3.9 |
| Avg. | 3.7 | 3.5 |
| After 50 launderings | 4.3 | 3.4 |
| | 4.2 | 3.5 |
| | 4.6 | 3.3 |
| | 4.3 | 3.4 |
| | 4.4 | 3.6 |
| | 4.4 | 3.4 |
| After 75 launderings | 4.1 | 3.6 |
| | 4.0 | 5.8 |
| | 4.4 | 5.2 |
| | 4.6 | 6.2 |
| | 4.3 | 5.4 |
| | 4.3 | 5.2 |
| After 101 launderings | 3.0 | 3.3 |
| | 2.9 | 3.5 |
| | 3.1 | 2.9 |
| | 3.3 | 3.3 |
| | 3.5 | 3.6 |
| | 3.2 | 3.3 |

**Samples laundered according to AATCC Method 135 (3)IIIA(iii).
Permanent Press Laundering Cycle 105° F, Tumble Dry Permanent Press.

FIGURE-12A

Item : One (1) sample fabric identified as:

Description: White jersey-6.1 OZ

Purpose : Wicking, PTL Method 1040

| Test | | Results | |
|---|---|---|---|
| **Wicking**** | | Length Direction | Width Direction |
| **PTL Method 1040** | | | |
| **Vertical Position, 3" benchmarks** | | | |
| **Time (minutes)** | | | |
| As Received | | 3.01 | 6.06 |
| | | 3.04 | 6.01 |
| | | 2.57 | 6.13 |
| | Avg. | 2.87 | 6.07 |
| After 25 Launderings | | 1.44 | 1.48 |
| | | 1.50 | 1.56 |
| | | 1.35 | 1.43 |
| | Avg. | 1.43 | 1.49 |
| After 50 Launderings | | 1.44 | 2.10 |
| | | 1.44 | 1.52 |
| | | 1.52 | 1.43 |
| | Avg. | 1.47 | 1.68 |

**Samples laundered according to AATCC Method 135 (3)IIIA(iii).
Permanent Press Laundering Cycle 105° F, Tumble Dry Permanent Press.

FIGURE-12B

Item : One (1) sample fabric identified as:

Description: White jersey-7.2 OZ

Purpose : Wicking, PTL Method 1040

| Test | | Results | |
|---|---|---|---|
| **Wicking**** | | Length Direction | Width Direction |
| **PTL Method 1040** | | | |
| **Vertical Position, 3" benchmarks** | | | |
| **Time (minutes)** | | | |
| As Received | | 4.57 | 10.23 |
| | | 5.01 | 9.01 |
| | | 4.37 | 11.45 |
| | Avg. | 4.65 | 10.23 |
| After 25 Launderings | | 2.01 | 2.08 |
| | | 2.07 | 2.15 |
| | | 1.50 | 1.51 |
| | Avg. | 1.86 | 1.91 |
| After 50 Launderings | | 2.11 | 2.17 |
| | | 1.47 | 2.01 |
| | | 2.00 | 2.06 |
| | Avg. | 1.86 | 2.08 |

**Samples laundered according to AATCC Method 135 (3)IIIA(iii).
Permanent Press Laundering Cycle 105°F, Tumble Dry Permanent Press.

FIGURE-12C

Item : One (1) sample fabric identified as:

Description: White woven-8.1 OZ

Purpose : Wicking, PTL Method 1040

| Test | | Results | |
|---|---|---|---|
| **Wicking**** | | Length Direction | Width Direction |
| **PTL Method 1040** | | | |
| **Vertical Position, 3" benchmarks** | | | |
| **Time (minutes)** | | | |
| As Received | | NA | NA |
| | | NA | NA |
| | | NA | NA |
| | Avg. | NA | NA |
| After 25 Launderings | | 1.27 | 1.38 |
| | | 1.30 | 1.35 |
| | | 1.16 | 1.31 |
| | Avg. | 1.24 | 1.35 |
| After 50 Launderings | | 1.36 | 1.26 |
| | | 1.21 | 1.15 |
| | | 1.17 | 1.25 |
| | Avg. | 1.25 | 1.22 |

**Samples laundered according to AATCC Method 135 (3)IIIA(iii).
Permanent Press Laundering Cycle 105° F, Tumble Dry Permanent Press.

FIGURE-12D

Item :

One (1) sample fabric identified as:

Description: Yellow 3-end fleece-10.15 OZ

Purpose :

Wicking, PTL Method 1040

Test

| **Wicking**<br>**PTL Method 1040**<br>**Vertical Position, 3" benchmarks**<br>**Time (minutes)** | | **Results**<br>Length Direction | <br>Width Direction |
|---|---|---|---|
| As Received | | | |
| | | 2.54 | 2.07 |
| | | 3.16 | 1.54 |
| | | 3.14 | 2.03 |
| | Avg. | 2.95 | 1.88 |
| After 25 Launderings | | | |
| | | 0.51 | 1.46 |
| | | 0.50 | 1.48 |
| | | 0.46 | 1.58 |
| | Avg. | 0.49 | 1.51 |
| After 50 Launderings | | | |
| | | 0.47 | 1.48 |
| | | 0.50 | 1.47 |
| | | 0.49 | 1.38 |
| | Avg. | 0.49 | 1.44 |

**Samples laundered according to AATCC Method 135 (3)IIIA(iii).
Permanent Press Laundering Cycle 105° F, Tumble Dry Permanent Press.

FIGURE-12E

SYNTHETIC-RICH FABRICS

CROSS-REFERENCE TO RELATED APPLICATIONS

The present application claims the benefit under any applicable U.S. and/or PCT statute to U.S. Provisional Application No. 60/647,272 filed 24 Jan. 2005, titled PRINT AND DYE RECEPTIVE SYNTHETIC RICH FABRIC in the name of Frederick Michael Greenspoon.

This application incorporates by reference U.S. Provisional Application No. 60/647,272 as if said application was fully set forth herein.

FIELD OF THE INVENTION

The present invention relates generally to synthetic-rich fabrics and, more particularly to apparel and non-apparel items having improved physical and qualitative properties (e.g. print and dye receptivity, pilling, wicking, UV protection, etc.).

BACKGROUND OF THE INVENTION

Woven fabrics that are 100% synthetic (e.g., polyesters, polypropylene, nylon, acrylic and elastane fibers), with a tight surface, are a good receptive fabric choice for dye sublimation heat transfer applications. However, 100% synthetic fabrics make poor articles of apparel, and poor non-apparel items (e.g., napkins, tablecloths or aprons), because these fabrics are hydrophobic and repel or are resistant to moisture, and tend to be harsh to the touch.

Some newer 100% polyester fabrics, with hydrophilic wicking ability, have been produced with the intent of addressing these concerns. Several methods are used in order to make synthetic fabrics more amenable to wicking moisture (i.e., make them more hydrophilic).

One method to make synthetic fibers more hydrophilic is to treat them with a wicking agent. These fibers can then be made into yarn that is then constructed into fabric. The resulting fabric is then hydrophilic.

Alternatively, hydrophobic fibers can be made into yarn that is then treated with a wicking agent. When constructed into fabric, this yarn makes the fabric hydrophilic.

Finally, a hydrophobic fabric can be treated with a wicking agent to make it more hydrophilic.

Regardless of the method used to make synthetic fabrics more hydrophilic, many wicking agents or treatments usually wash out after a few washes, and others have been permanently damaged or neutralized after exposure to severe temperature, pressure and dwell time (such as when undergoing a dye sublimation heat-transfer application—exposure to about 400 degrees Fahrenheit and to about 50 pounds of pressure per square inch, more or less, for approximately thirty seconds), and still others may not perform as well.

Until recently, the only fabric available for dye sublimation heat transfer applications that was also suitable for apparel use, was a "plated" fabric. This fabric is made on a double-knit knitting machine. This knitting machine is set up to produce a knit fabric having two distinct sides with different fabric compositions. One example is where the surface or face side is 100% polyester, and the reverse or backside is 100% cotton. The actual blend of the fabric would be 50% polyester, 50% cotton. Although this fabric is print receptive, and the reverse or backside of the fabric (cotton side) is hydrophilic, or receptive of moisture, the fabric demonstrates a slightly lower resolution for a dye sublimation heat transfer print, when compared to another fabric that is 100% synthetic and has the identical heat transfer applied. This is because of slight "grin through", or the phenomenon where some of the cotton fibers from the reverse, or backside of the fabric, come through to the surface of the fabric.

Cotton fibers do not readily accept the sublimable dyes and the sublimable dyes are not fully colorfast on cotton. In addition, because the polyester side of the fabric remains hydrophobic, it could be uncomfortable when made into apparel. The hydrophobic surface of the polyester can act like a shield or barrier to the cotton side of the fabric, and inhibit the transmission of moisture through to the surface. Also, after going through the process of a dye-sublimation transfer application, the surface of the fabric plates becomes shiny and very slick (or slimy) to the touch. In addition, the plated fabrics tend to shrink more than polyester.

The formula for dye sublimation heat transfer application varies, and depends on the transfer manufacturers' directions. There are many types of dyes and paper substrates that can be used in the manufacture of the heat transfers, in addition to many different ways to make the transfers. Time of application can vary from a low of about 15 seconds to a high of about 35 seconds. Pressure from the application can also vary from a low of about 20 psi, to a high of about 50 psi. Temperatures can also vary from about 340 F to about 400 F, or more.

There is a need in the market place for truly "no-care", synthetic-rich fabrics that are highly adaptive and print receptive, having the hydrophilic characteristics necessary to withstand the severe conditions of the dye-sublimation heat-transfer process, in addition to having other characteristics that will allow the fabrics to withstand the many washings that will follow, both domestic and commercial/industrial. For apparel, additional desirable characteristics include: functional, comfortable, soft cotton-like feel, affordable, stylish, zero to low shrinkage, ease of cleaning, stain and soil resistant, chlorine bleach resistant, wrinkle resistant, colorfastness, long lasting, durable, and UV protection. Many of the same characteristics that are desirable for apparel are desirable for non-apparel items.

Americans are more concerned about skin cancer than ever before. UV rays damage the skin in many ways, causing premature wrinkles, sunburn, cataracts and skin cancer. The Skin Cancer Foundation (www.skincancerfoundation.org), estimates that nearly 1,000,000 Americans will be diagnosed with skin cancer this year. In addition, one American per hour dies from skin cancer, mostly melanoma, and that 1 in 5 Americans will be diagnosed with skin cancer in their life times. California has the "Billy Law" requiring students in school to wear hats during outside activities. Many states now cover workmen's compensation claims from employees who work outside and develop skin cancer.

Wearing apparel with UV protection helps decrease the damage done by these rays. In warmer climates, it is important to have lighter weight clothing that is both comfortable to wear and has adequate UV protection. Although cotton is highly breathable and comfortable to wear, it proves to be an inadequate material for UV protection. Alternatively, polyester is an excellent material for UV protection, but in order to be comfortable, the fabric would also need to have wicking capabilities necessary for breathablity.

The FTC recently set standards to label apparel for UV protection, requiring that a UPF rating be determined. This standard is nearly identical to the SPF ratings given to sunscreen and cosmetics. UPF stands for "Ultra-violet Protection Factor". A number is associated with the protective factor of the fabric. There are laboratory tests to determine the UPF rating of a fabric. One test is UV Protection Factor, AATCC 183-2000A. This FTC standard requires that 2 types of invisible UV rays be tested for penetration through the fabric. Both UVA and VB rays are measured. A rating of UPF15+ is the minimum rating of fabric that is allowed for labeling purposes. A rating of UPF 15+, means that less than of 1/15 of all UV rays penetrate the fabric and reach the surface of the skin, and represents a blockage of a minimum of 93.3% of all UV rays. A rating of UPF 50+ is the highest rating possible for labeling purposes of apparel, and means that less than 1/50 of all UV rays penetrate the fabric and reach the surface of the skin, and represents a minimum blockage of a minimum of 98% of all UV rays. There are three levels of protection (see table below).

| UPF RATING | CATEGORY of PROTECTION | UV % BLOCKED |
|---|---|---|
| 40-50+ | Excellent UV protection | 97.5%-98.0% |
| 25-35 | Very Good UV protection | 96.0%-97.4% |
| 15-20 | Good UV protection | 93.3%-95.8% |

Most light weight cotton t-shirts and polo shirts only have a UPF rating of UPF 6 or 7. Certainly well under the minimum standards set by the FTC for UV protective clothing. At the present time, apparel that has a UPF40+ to UPF50+ rating is relatively expensive to manufacture. More often than not, these garments are of heavier weight and although they provide exceptional UV protection, are not really practical for warm, hot or tropical weather. There is a need in the market for lightweight %-shirts and polo shirts that have "Excellent" UPF ratings of UPF40+ to UPF50+, rated both dry and wet, with a high degree of wicking, and that are more economical to manufacture. These garments would also be perfect for babies and children, where sun block lotions must be constantly addressed throughout the day.

Iron-on heat transfers, and specifically, dye-sublimation heat-transfers, have been around for many decades. In the iron-on process, sublimable dyes are printed onto a substrate, such as paper. There are many ways to print these transfers, such as: rotary screen, flat screen, roller print or digital. This printed substrate (the dye sublimation heat transfer) is then placed onto a host fabric where it undergoes a process whereby specific heat and specific pressure are applied to the transfer and fabric, or article of apparel or non-apparel, for a specific period of time. The substrate is then removed and the image has been "transferred" into the host fabric. The dyes "explode" under heat and pressure, turning into a gas, and this gas dyes the synthetic fibers in the host fabric, or article of apparel or non-apparel.

A true "no care" article of apparel, or non-apparel item, having undergone a dye sublimation heat transfer process, should have the following beneficial or necessary characteristics: little to zero shrinkage, no twisting and/or torque after repeated washings, doesn't fade and is colorfast, stain and soil resistant, washable at home, pill resistant, wrinkle resistant, soft, chlorine bleach resistant, cotton-like feel, comfortable, resistance to bacteria, odor, mildew and fungus, wicking capability, and UV protection.

SUMMARY OF THE INVENTION

The present invention relates to an improved, synthetic-rich, pill-resistant fabric that has additional properties of consistent high rate of wicking after 25, 50, 75 and over 100 washes, on a different wicking test getting a perfect score of 0.00 for many different fabrics after as many as 50 washes, color change rating of up to 4.5 after over 100 domestic washes, zero shrinkage after 5, 10, 20, 30 and 40 commercial/industrial washes on different t-shirts, stain and soil resistant with perfect scores as high as 5 on stains such as hamburger grease, butter sauce, pepperoni, mustard, pizza sauce, cooking oil after 50 washes and score of 4.5 on over 100 domestic washes, pilling rating of about 4.0 after 5 commercial washes, having good general appearance after 5 commercial washes, smoothness of appearance of up to 5.0 after 5 commercial washes, smoothness of seams of up to 5.0 after 5 commercial washes, crocking index up to 5, with a soft hand and cotton-like feel, skewness rating as low as 0.0 after 5 commercial washes, colorfastness rating of up to 5.0, and with UV protection with a rating of UPF50+ in several different fabrics, after repeated washes, both wet and dry, in multiple colors and meeting the FTC labeling requirements of "Excellent", and articles of apparel and non-apparel items such as bedding, home accessories, home furnishings, and other miscellaneous items, all made of same fabric, that retains all of these properties after the process of a dye sublimation heat-transfer application, and after repeated domestic and commercial/industrial washing.

In accordance with the present invention, the more print receptive synthetic fibers available per square inch on the surface of the host fabric, or article of apparel or non-apparel, the greater the resolution of the transferred image. A fabric with a surface content of 50% cotton and 50% polyester will have roughly half the resolution of a similar fabric with a surface content of 100% polyester, when identical dye sublimation heat transfers are applied to each fabric. This difference would be similar to the difference between watching identical images on an analog TV and on a high definition plasma TV. For this reason, the ideal host fabric for dye sublimation heat-transfer applications is a fabric that has a tight, 100% synthetic surface.

The fabric disclosed herein achieves certain physical and qualitative properties when compared to prior art synthetic fabrics by using a unique combination, in no particular order, of: available polyester fiber, fiber size, yarn type and size, fabric choice and fabric construction, as well as dyeing, chemical additives, drying and finishing techniques. In a preferred embodiment, Fortrel polyester fiber is used in denier sizes ranging, from about 0.75 denier to about 1.5 denier, and made into 100% polyester air-jet yarn, ranging from 10/1 to 30/1 (ten singles to thirty singles), and then knit or woven, as necessary, to create a tight surface construction, so as not to distort the face of the fabric, where fabric is then dyed and treated in a jet-dying machine, where dye and a 5% Polymeric/Surfactant blend, such as Hydrowick® hydrophilic treatment (manufactured by Hydrotex USA, Inc. of Raleigh, N.C., USA) is exhausted into the fabric, where fabric is then dried and "heat-set" to proper width. Knit fabric weight in ounces per square yard preferably range from 4.4 to 10.75, and woven fabric weight is about 8 ounces per square yard.

BRIEF DESCRIPTION OF THE DRAWINGS

FIG. 1A is a report of the test results after a battery of industrial laundry test, including dimensional stability and skewness for a t-shirt made from 6.2 ounce per square yard black jersey fabric manufactured in accordance with the present invention;

FIG. 1B is a continuation of the report presented in FIG. 1A, including general appearance, smoothness appearance, smoothness seams, color change, and piling for a shirt made from fabric manufactured in accordance with the present invention;

FIG. 3 is a report of the test results for colorfastness after 101 repeated home launderings of 6.2 ounce per square yard jersey fabric manufactured in accordance with the present invention;

FIG. 4A is a report of the test results for a stain test conducted over 101 domestic wash/dry and restoration cycles of a 6.2 ounce per square yard yellow jersey fabric manufactured in accordance with the present invention;

FIG. 4B is a report of the test results for a stain test conducted over 50 domestic wash/dry and restoration cycles of a 5.9 ounce per square yard light tangerine colored double knit fabric manufactured in accordance with the present invention;

FIG. 4C is a report of the test results for a stain test conducted over 50 domestic wash/dry and restoration cycles of an 8.1 ounce per square yard white woven fabric manufactured in accordance with the present invention;

FIG. 4D is a report of the test results for a stain test conducted over 50 domestic wash/dry and restoration cycles of a 10.75 ounce per square yard yellow 3-end fleece fabric manufactured in accordance with the present invention;

FIG. 5A is a report of the test results for UV Protection Factor (UPF) test for an orange jersey and a yellow jersey;

FIG. 5B is a report of the test results for UV Protection Factor (UPF) test for a relatively lightweight white jersey;

FIG. 5C is a report of the test results for UV Protection Factor (UPF) test for a relatively middle-weight white jersey;

FIG. 5D is a report of the test results for UV Protection Factor (UPF) test for a relatively heavier-weight white jersey;

FIG. 5E is a report of the test results for UV Protection Factor (UPF) test for a different relatively middle-weight white jersey;

FIG. 6A is a report of the test results for UV Protection Factor (UPF) test for a double-knit light orange fabric;

FIG. 6B is a report of the test results for UV Protection Factor (UPF) test for white woven fabric;

FIG. 7 is a report of the test results for UV Protection Factor (UPF) for a white fabric with a printed dye sublimation heat transfer application;

FIG. 8 is a report of the test results for colorfastness to laundering;

FIG. 9 is a report of the test results for crocking resistance;

FIG. 10 is a report of the test results for moisture vapor transmission;

FIG. 11 is a report of the test results for wicking absorbency;

FIG. 12A is a report of the test results for wicking for a yellow jersey;

FIG. 12B is a report of the test results for wicking for a middle-weight white jersey;

FIG. 12C is a report of the test results for wicking for a heavier-weight white jersey;

FIG. 12D is a report of the test results for wicking for a relatively heavy-weight white woven fabric; and FIG. 12E is a report of the test results for wicking for a relative heavy-weight yellow fleece fabric.

DETAILED DESCRIPTION OF THE INVENTION

Figure 2:
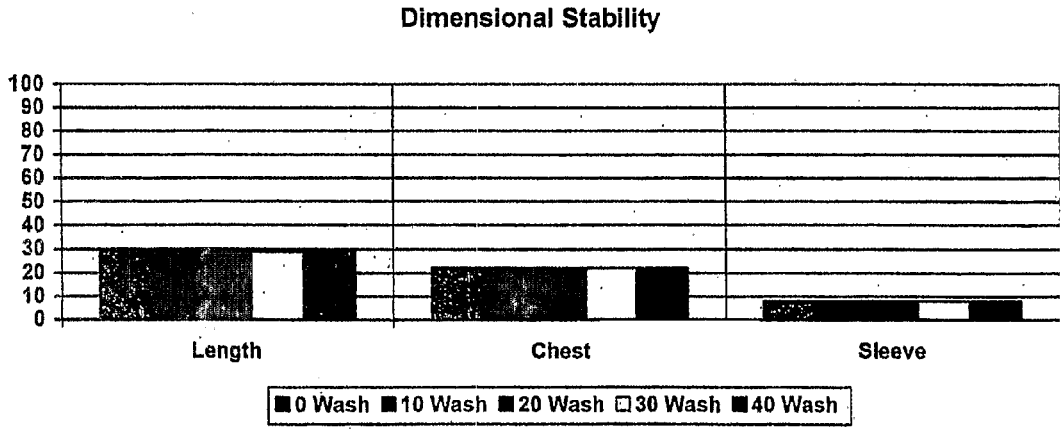
FIG. 2 is a report of the test results for a dimensional stability test on 5 different t-shirts, made from 6.2 ounce per square yard yellow jersey fabric manufactured in accordance with the present invention.

Synthetic fibers, yarn and fabric are inherently hydrophobic (that is, they tend to repel or are resistant to moisture). Thus, apparel made from synthetic or synthetic rich fabric would hold moisture against the skin and cause the wearer to become hot and uncomfortable. (As used herein, "synthetic-rich" fabric is any fabric that has a significant percentage of synthetic fibers—usually >30%.) In addition, many synthetic fabrics may be shiny, slimy to the touch, and/or have excessive surface pilling after repeated washes.

It has been found that some of the properties that affect the level of UPF protection are: fabric content, thickness of the fabric, tightness of construction, regardless of whether the fabric is wet or dry, if the fabric is stretched, dyes in the fabric or chemical treatments. With respect to UV protection, cotton is one of the worst protective fibers, while polyester proves to be one of the best. A tight construction, where the yarns are very tight, allows less room for the invisible UV rays to penetrate, and will help increase UPF numbers. Dyes have the ability to absorb more or less of the UV rays, and generally white provides less UV protection than colors. Thicker fabrics have excellent UPF numbers, but tend to be uncomfortable to wear under warm, tropical or summer-time conditions.

The ideal fabric for people that are outside for pleasure or recreation would be a lightweight, 100% polyester, jersey fabric having ultraviolet UPF protection (according to the FTC guidelines above) of as much as UPF50+, a high rate of wicking, soft-hand and cotton like feel, jersey fabric, with a weight of about 5.5 to 7.5 ounces per square yard. Fabrics having the aforementioned qualities, of this weight, mirror much of the most popular clothing people wear today in cotton and cotton blends. However, cotton does not offer much UV protection, certainly not within the FTC guidelines. In contrast, t-shirts, polo shirts, as well as most beach cover-ups made of 100% polyester fabric, would protect millions of people from unnecessary UV exposure.

A fabric with a UPF rating when wet would make ideal clothing for the beach for adults, kids and babies. Fabric and apparel meeting the above expectations, with sublimation heat transfer image applications, would be a welcome addition to the market place. Other features, such as a high rate of wicking that lasts over 100 washes, colorfastness better than cotton, zero to low shrinkage, zero twisting or torque, exceptional stain and soil release through over 100 washes, low pilling, wrinkle resistant, bacteria, odor, mildew and fungus resistant, colorfast non-fading, wicking heat applied images, soft cotton-like feel and costs competitive with cotton apparel would make this type of apparel perfect for warm, summer-like conditions.

In addition to the millions of people who enjoy being outside for pleasure or recreation, there are also many millions of people who work outside. Therefore, a synthetic-rich, high rate of wicking clothing or uniforms with the highest degree of UV protection meeting the FTC standards, in addition to all the previously-mentioned desirable characteristics, would be ideal. In addition, if the fabric could be made in a high-visibility color, it would be highly desirable in jobs that are inherently dangerous (e.g., department of transportation workers, forest rangers, night watchman, etc.). Fabric and apparel meeting the above expectations, with sublimation heat transfer image applications, would also be of great benefit, where the sublimation image also has all of the characteristics of the fabric.

There are also millions of employees who work in restaurants. One of the problems faced by these employees, and more so by their employers and business owners, is dealing with stained uniforms, aprons, napkins and tablecloths. Some stains are never fully removed from these items. Some of the worst stains are: corn oil, pepperoni grease (because of the dyes in the pepperoni), hamburger grease, mustard, coffee, pizza sauce and butter. In order to mask residual stains, many restaurants outfit their employees in black, or very dark colored garments, or fabrics with very busy patterns. These restaurant outfits are also treated with stain and soil-release chemicals. However, most stain and soil-release fabrics lose their stain release properties after as few as 15 or 20 washes. Many fast food restaurant chains view a stain release score of 3.5, on a scale of 1 to 5 (where 1 is the poorest score and 5 being the best score with no visible stain), on Soil Release: Oily Stain Method, AATCC 130 test, at 30 washes, to be an excellent score. (It should be noted that such a score would be one of the highest currently available on the market.) There is a similar problem with these same stains on non-apparel items such as aprons, napkins and tablecloths.

Cotton absorbs moisture well, but is difficult to remove many stains. Polyester-cotton blends are better for stain release, but there is still difficulty removing many stains. In addition, the polyester in apparel, and in aprons, napkins and tablecloths, is not as absorbent as cotton (the polyester is hydrophobic), and makes the person wearing the polyester-cotton blend warmer than they would be compared to wearing a 100% cotton fabric, especially in the kitchen near hot ovens and hot fryers. The napkins, tablecloths and aprons made of a polyester-cotton blend also tend to have a harsh hand and feel rough to the touch. A napkin laid in a person's lap (where the legs are bare) becomes uncomfortable with the fabric touching the skin because of the warmth of the fabric and the harsh, rough hand.

Aprons, napkins and tablecloths made of 100% polyester that have some degree of stain and soil release are available. However, although some are hydrophilic with some degree of moisture absorption, the type of polyester fiber used in the manufacture of this fabric has a rough to extremely rough hand and is actually worse when put in the lap on bare legs. A solution for both problem situations of these apparel and non-apparel items, would be synthetic rich fabrics, with long lasting high degree of wicking, long lasting high degree of stain and soil release, zero to low shrinkage, colorfastness, durable, with a soft, cotton-like hand and cotton-like appearance. Additional properties that would be an added benefit for apparel, aprons, napkins and tablecloths would be: zero twist and torque of apparel, low crocking, low pilling, resistance to wrinkles, little to no color change. A huge benefit would be apparel, aprons, napkins and tablecloths made of fabrics that, in addition to the above, dye sublimation heat transfer images applied with logos or advertising, where the image area also wicks, is stain and soil resistant, and even with the image on the fabric, these items can easily be cleaned and still retain their original properties even after over 100 home washings, or can withstand commercial/industrial laundering, with little effect. Ideally, chlorine bleach has no effect on the dyes used to color the polyester fabric, or on any sublimation image that has been transferred onto the fabric.

Most employees who either work outdoors, in restaurants or in kitchens, are provided uniforms by their employers. Many employers or companies use uniform rental companies to provide weekly pickup of dirty uniforms, and to drop off of clean ones. These rental companies operate their own laundry. These uniforms are washed and dried in an industrial laundry environment using much higher wash and dry temperatures than experienced in the home, harsher detergents and chemicals than are used in the home, and much larger loads than are used in the home, ranging from between 100 to 200 lbs, or more, in addition to higher PH levels. Incredible stress is put on these uniforms during a commercial laundry process. Fabric, apparel and non-apparel items must be able to withstand this harsh environment.

Printed or dyed cotton sheets and pillowcases tend to fade after repeated washing. Polyester-cotton blends tend to make a person too warm when under the sheets in warm weather, in addition to not being as soft as cotton. Sheets and pillowcases made of a synthetic, or synthetic rich fabric, with a soft, cotton-like hand, that wicks, has stain and soil release, low pilling, colorfast, with little or no color change, zero to low shrinkage, zero twist and toque, low crocking and no wrinkling, does not exist today. In addition, there are no sheets or pillowcases made that have all of these characteristics in addition to being made of fabric that has dye sublimation heat transfer images with patterns, logos, advertising, etc, where the image area also wicks, is stain and soil resistant, colorfast, low crocking, along with the other characteristics listed above. In accordance with the present invention, non-apparel items such as sheets, pillowcases, napkins, tablecloths, etc., even with the image on the fabric, can be easily cleaned and still retain their properties even after over 100 home washings, are resistant to chlorine bleach and can also withstand repeated commercial/industrial laundering, with little to no effect.

There are nearly an infinite number of fabrics that can be made. Possibly nearly an infinite amount of synthetic and synthetic blends as well. When you extrapolate the various types of fiber available, sizes of fiber, and the types of yarn the fibers can be made into, the blends of the yarn, sizes and counts of yarn, various types of machinery, equipment and processing available to make knits, wovens and non-wovens, the amount and types of fabric jersey, twill, pique, fleece, etc), the needle arrangements and draw factors of yarn being made into fabrics, the various array of dyes and chemicals, choice of colors and shade, dye machines, finishing processes, etc; you would come up with a number for the possible different fabrics available with more than 20 zeros, or more after it (X00,000,000,000,000,000,000), that would represent one particular fabric possibility out of all fabrics possible, that has one set of unique characteristics. The present invention has novel characteristics that are not shown in fabrics that have been produced to date.

In a preferred embodiment, Fortrel polyester fiber, in denier sizes ranging from 0.75 to 1.5 denier were used in the manufacture and process of the various air-jet 100% polyester yarns, used in the construction of several fabrics, as well as some open-end 100% polyester yarn, in counts ranging from 10/1 to 30/1. There are many different types of polyester fiber available. These fibers also come in a multitude of denier sizes. There are also many different kinds of yarn that can be made from this assortment of fibers and types of polyester. Micro-denier fibers (fibers under 1.0 denier, or 1 denier and under, depending on definition) in a yarn help give fabric a softer hand characteristic. Air jet polyester yarn, tends to help give fabric more of an anti-pill characteristic. A tighter construction produces a fabric with a soft hand, anti pilling, with a perfect print receptive surface and good UV protection.

However, these fibers and this yarn are hydrophobic. Knitting of this yarn, in varying counts and combinations ranging from 10/1 to 30/1, was conducted to produce different type fabrics (single knit jersey, double knit and 3-end fleece), some of which are relatively flat on the surface, and tightly constructed in various degrees, without distorting the face of the fabric. In addition, some fabric was knit with up to 3% Spandex (styles S45 and S85), in counts of 40 and 60 denier, another fabric with up to 35% nylon, and another fabric with up to 8% Lycra were used, in addition to the air-jet polyester yarn. Woven fabrics were also constructed using the same Fortrel fiber and air-jet 100% polyester yarn, in counts ranging from 12/1 to 18/1, with a flat surface and tightly constructed without distortion.

Most knit fabrics are produced on circular knitting machines. Fabric was made for both tubular (body size) and open width processing. Both types of fabric were processed for dye and chemical applications, as well as for finishing, and apparel and non-apparel manufacturing. Sizes created for tubular applications ranged from 18" to 34", tubular, and from 44" to 72", open width. Nearly 20 different machines were used to make various fabrics, and test results varied only slightly. Woven fabric was made for 62" open width. Weights of fabric ranged from the 4 ounces per square yard range to the 16 ounces per square yard, range, after dyeing and finishing.

In the preferred embodiment, the fabric is scoured, or dyed, in jet-dyeing machines, and treated with an approximate 5% solution of polymeric/surfactant wicking agent (e.g., HydroWick®), which is exhausted into the jet dyeing machine. Other chemicals may be added in the normal course of fabric processing, such as acetic acid, or hydrophilic softeners, or other compounds or chemicals that dye houses and finishers normally use in the process of dyeing and finishing fabrics. Jet dyeing machines are computerized, pressure dyeing machines that dye and treat fabrics utilizing various temperatures, various pressures and varying times of application, in addition to varying formulas and sequences for dyes and chemicals, and different ways to put the dyes and chemicals into the jet-dye machines. Fabric is then finished, dried and synthetic or synthetic rich fabrics are heat-set with temperatures under 400 degrees F., to set widths, minimize shrinkage and give the fabric memory. Additionally, some synthetic or synthetic rich fabrics may require an additional step of heat-setting greige fabric, in the case of fabrics with a 3% or higher percentage of elastane. Also, synthetic or synthetic rich fabrics requiring napping would be heat-set a second time after napping. Fabric is then packaged and either rolled or flat folded is sizes of varying weights.

In addition to treating the fabric with HydroWick, other embodiments of the present invention use Lubril-QCX, SRA-30 or Megafor-ADO, as a wicking agent. All fabric is scoured, or dyed, in jet-dyeing machines, and treated with a solution of a suitable wicking agent, which is exhausted into the jet dyeing machine. Other chemicals may be added in the normal course of fabric processing, such as acetic acid, or hydrophilic softeners, or other compounds or chemicals that dye houses and finishers normally use in the process of dyeing and finishing fabrics. Jet dyeing machines are computerized, pressure dyeing machines that dye and treat fabrics utilizing various temperatures, various pressures and varying times of application, in addition to varying formulas and sequences for dyes and chemicals, and different ways to put the dyes and chemicals into the jet-dye machines. Fabric is then finished, dried and synthetic or synthetic rich fabrics are heat-set with temperatures under 400 degrees F., to set widths, minimize shrinkage and give the fabric memory. Fabric is then packaged and either rolled or flat folded is sizes of varying weights.

A preferred process for making a dyed fabric will be described.

Procedure in Accordance with the Present Invention for Scouring Synthetic and Synthetic Blend Fabrics Scholl-America Colorstar Jet Dye Machines The jet is filled to load volume with 100° F. water. 0.5% defoamer MC-1 is added to water volume. The fabric is then loaded into water/defoamer mixture.

1.0% J-Scour WPE is added to jet and circulated for 4 minutes. 5.0% Hydrowick BC is added to jet and run for 2 minutes.

The temperature of the jet is increased by 3° F. per minute until it reaches 180° F. The fabric is circulated for 5 minutes at this temperature.

The temperature is then raised by 2° F. per minute until 265° F. is reached and held for 30 minutes.

The temperature is then reduced at 2° F. per minute until it reaches 140° F.

The temperature is then reduced to 100° F. over 10 minutes using an overflow wash using 100° F. water.

The jet is then drained and filled to volume with 100° F. water.

The jet then overflow washes for 10 minutes using 100° F. water.

Since no dye is used the above procedure relating to after clear chemicals is not necessary.

The pH is then checked to make sure it is within specified range and the shade is checked to make sure it matches standard.

The fabric is then unloaded and the jet drained.

The fabric is then slit in a conventional manner and heat set on a tenter frame at 380° 390° F.

SCOURED FLEECE FABRIC—After the above procedure, the fabric is then taken from the Tenter frame to the Napper for brushing—

Napping procedure; at T frame, pad on-NAP ASSIST (lubricant) prior to napping. Then fabric taken back to Tenter frame-run at lower heat than before, at about 350 F, just enough heat to get fabric reoriented into the pre hest set condition.

SCOURED STRETCH FABRIC-composed of more than 5% Elastane (LYCRA/SPANDEX)—Greige fabric is run on the Tenter frame at about 400 F. before scouring. Light weight fabrics as low as low as 3% elastane, or heavy weight fabrics as high as 8% elastane may not need this process. After the greige fabric is run on the Tenter frame, the above procedure is followed.

TUBULAR HEAT SETTING-takes the place of the Tenter frame for heat setting the fabric-Rings pull the fabric to a set width under high heat. Heat setting can take place on greige fabric prior to the above procedure, or on scoured fabric following the above procedure, where comparable temperatures to the Tenter frame are used. This process is ideal for fabric used in body size apparel, such as t-shirts or polo shirts.

PROCEDURE IN ACCORDANCE WITH THE PRESENT INVENTION FOR PROCEDURE FOR DYEING SYNTHETIC and SYNTHETIC BLEND FABRICS SCHOLL-AMERICA COLORSTAR jet dye machines The jet is filled to load volume with 100° F. water. 0.5% defoamer MC-1 is added to water volume. The fabric is then loaded into water/defoamer mixture.

1.5% Acetic Acid, 1% Chem Assist T and any dye combination necessary to achieve desired color is added to jet and circulated for 5 minutes. 5.0% Polymeric/Surfactant blend**** is added to jet and run for 2 minutes.

The temperature is then raised by 4° F. per minute until 265° F. is reached and held for 30 minutes.

The temperature is then reduced at 2° F. per minute until it reaches 170° F.

The shade is checked to make sure it matches standard.

3% Pressclear AW is added to the jet and run for 15 minutes.

The temperature is then reduced to 110° F. over 10 minutes using an overflow wash using 100° F. water.

The jet is then drained and filled to volume with 120° F. water.

The jet then overflow washes for 10 minutes using 100° F. water.

The jet is then drained and filled with 80° F. water and run for 5 minutes.

The pH is then checked to make sure it is within specified range and the shade is checked to make sure it matches standard.

The fabric is then unloaded and the jet drained.

The fabric is then slit in a conventional manner and heat set on a Tenter frame at 380°-390° F.

****Polymeric/Surfactant blend—this is a group of chemical treatments known for wicking and stain and soil release properties. Hydrowick, Lubril QCX and SRA-30 are a few of the various treatments used in our fabrics and testing.

DYED FLEECE FABRIC—After the above procedure, the fabric is then taken from the Tenter frame to the Napper for brushing—

Napping procedure; at T frame, pad on-NAP ASSIST (lubricant) prior to napping. Then fabric taken back to Tenter frame-run at lower heat than before, at about 350 F, just enough heat to get fabric reoriented into the pre hest set condition.

DYED STRETCH FABRIC—composed of more than 5% Elastane (LYCRA/SPANDEX)—Greige fabric is run on the Tenter frame at about 400 F. before dyeing. Light weight fabrics as low as low as 3% elastane, or heavy weight fabrics as high as 8% elastane may not need this process. After the greige fabric is run on the Tenter frame, the above procedure is followed.

TUBULAR HEAT SETTING—takes the place of the Tenter frame for heat setting the fabric-Rings pull the fabric to a set width under high heat. Heat setting can take place on greige fabric prior to the above procedure, or on dyed fabric following the above procedure, where comparable temperatures to the Tenter frame are used. This process is ideal for fabric used in body size apparel, such as t-shirts or polo shirts.

Starting with hydrophobic fiber and yarn, research was done to identify the best possible treatment to make the fabric hydrophilic. There are scores of Polymeric/Surfactant blends, and many different ways to treat the fabric with these various agents. HydroWick and Lubril-QCX were chosen because of their long-lasting characteristics, performance, consistent, ease of use and non-toxic characteristics. Most wicking agents in the market place today, according to their literature, similarly claim their products offer long lasting wicking capabilities, soft hand characteristics and some stain and soil-release, in addition to various other claims.

Although available, no hydrophilic fabric softeners were used in the manufacture of any fabric tested. Softness of hand and cotton-like feel were achieved only from choice of, and combination of: fiber, fiber size, yarn, machinery, equipment or process for the manufacture of fabric, type of fabric, and the tension of yarns and tightness of construction, dyes and treatments, wet and dry processing, heat setting, finished size and way the fabric is packaged.

Some types of fiber can be inherently hydrophilic, or fibers can be treated to be hydrophilic, resulting in yarn, and then fabric that is hydrophilic because of the fibers used. In addition, hydrophobic yarn can be treated with various wicking agents that would produce a fabric that is hydrophilic. There are also several other methods for applying a wicking agent to hydrophobic fabric, such as padding on the wicking agent after the fabric is dyed, rather than exhausting it in a jet dyeing machine.

It is important to note that other brands of polyester, other types of synthetic fibers, other denier sizes of fiber, different types of yarn, blending other types of fiber, such as nylon, cotton, elastane or fibers with elastane properties, acrylic, etc, with a synthetic percentage greater than 51%, varying degrees of tightness in the fabric construction, other types of fabric, different dyeing machines and methods of dyeing, different dyes and how the fabric becomes hydrophilic, etc, are all within the scope of this application.

Our resulting fabric (and apparel and non-apparel items made from the same fabric) demonstrates the following characteristics:

Wicking after more than 100 domestic washes

The highest possible ratings on wicking tests at 0, 25, and 50 washes

Zero shrinkage after 5, 10, 20, 30 and 40 commercial/industrial wash and dry cycles, the highest possible ratings Skewness, twist and torque rating of 0.0 (highest possible rating) after 5 commercial/industrial washes, the highest possible ratings Smoothness of appearance rating of Class 4.5 out of a possible 5 (5 highest rating possible) after 5 commercial/industrial washes Smoothness of seams rating of Class 5 out of a possible 5 (5 highest rating possible) after 5 commercial/industrial washes, the highest possible ratings Color change Class 4.5 out of a possible 5 (5 being the highest rating possible) after 5 commercial washes Color change Class 4.5 out of a possible 5 (5 being the highest rating possible) after more than 100 domestic washes Pilling Class 4 out of a possible 5 (5 being the highest rating possible) after 5 commercial/industrial washes Colorfastness of Class 4.5 out of 5 (5 being the highest rating possible) after more than 100 domestic washes Resistance to chlorine bleach Stain resistance of Class 5 after 1, 25 and 50 domestic wash/dry cycles, and a minimum of 4.5 out of 5 (5 being the highest rating possible) after 75 and 101 domestic washes, where uncommon, harsh stain reagents <is that the correct word> were used, such as hamburger grease, pepperoni grease (2 different kinds), mustard, butter sauce, pizza sauce (2 different kinds), coffee, used cooking oil, and corn oil, the highest possible ratings Extensive UV testing was conducted on different colors and different fabrics. Tests were also conducted on dry and wet fabric, and yet more tests were conducted after 25 and 50 domestic wash and dry cycles. The highest possible rating of UPF50+ was achieved in most tests, both wet and dry, and after 25 and 50 washes. Most of the fabrics were white in color, and all fabrics UPF rating increased after repeated washes. UV protection increases after white fabric undergoes the process of dye sublimation heat transfer application scoring a UPF 15 with a minimum of 94% of all UV rays blocked, ranked as GOOD. And this same fabric showed nearly a 3% increase in overall UV protection when compared to the same white fabric before the sublimation print was applied.

The fabric made in accordance with the present invention in the test for colorfastness after the fabric undergoes a process of dye sublimation heat transfer application achieved a rating of Class 5 out of a possible 5 (where 5 is the highest rating possible).

The fabric made in accordance with the present invention in the test for crocking resistance after the fabric undergoes a process of dye sublimation heat transfer application achieved a rating of Class 5 out of a possible 5 (where 5 is the highest rating possible) for both wet and dry crocking The fabric made in accordance with the present invention in the test for moisture vapor transmission achieved a rate of 1313 g/m2/24 hr (rated Excellent) after the fabric undergoes a process of dye sublimation heat transfer application.

The fabric also exhibits bacterial, odor, mildew and fungal resistance because of fabric's ability to wick moisture Explanation of Test Results (It should be noted that ALL TESTS REPORTED WERE CONDUCTED AT INDEPENDENT, GOVERNMENT APPROVED LABORATORIES.)

A t-shirt made out of black jersey fabric, with a weight of about 6 ounces per square yard, finished tubular, and manufactured according to the present invention was tested for evaluation after being subjected to an accelerated, commercial, industrial laundry battery of tests. All commercial laundries use wash and dry procedures that put extreme stress on garments and fabrics. These facilities use higher water temperatures than in home use, have hotter dryer temperatures than in domestic dryers, have load sizes that can, and often exceed 100 lbs to 200 lbs, or more, use stronger types of detergents and chemicals than are typically used in home/domestic washes as well as higher PH levels in wet processing. Numerous tests were conducted to test for the typical shortcomings that befall garments and fabric in this very hostile environment.

AATCC Test Method 96-2004-

Dimensional Changes in Commercial Laundering of Woven and Knitted Fabrics Except Wool Referring to FIGS. 1A and 2, the test results for the dimensional stability test is shown.

1. Purpose and Scope 1.1 This test method is used for the determination of dimensional changes of woven and knitted fabrics made of fibers other than wool when subjected to laundering procedures commonly used in a commercial laundry. A range of laundering test procedures from severe to mild is provided to allow simulation of the types of laundering found in commercial laundry. Five drying test procedures are established to cover the drying techniques used.

1.2 These tests are not accelerated and must be repeated to evaluate dimensional changes for multiple launderings.

2. Principle 2.1 The dimensional change of woven and knitted fabric specimens subjected to washing, drying and restoration procedures typical of commercial laundering are determined by measuring changes in bench mark distances applied to the fabric before laundering.

Results

A t-shirt made out of black jersey fabric, with a weight of about 6 ounces per square yard, finished tubular, and manufactured according to the present invention was tested after 5 repeated wash/dry/restoration cycles. Width and length shrinkage were each 0.0, after 5 wash/dry/restoration cycles as illustrated in FIG. 1.

Referring now to FIG. 2, four yellow t-shirts with a weight of about 6.2 ounces per square yard, finished tubular, and manufactured according to the present invention were tested after being subjected to 10, 20, 30 and 40 commercial industrial wash/dry/restoration cycles. The fabrics exhibited zero shrinkage for width and length were replicated through 10, 20, 30 and 40 wash//dry/restoration cycles. A fabric, or garment, cannot have better results than zero shrinkage in both the width and length directions of the fabric, especially after 40 commercial/industrial wash/dry/restoration cycles.

AATCC Test Method 179-2004-

Skewness Change in Fabric and Garment Twist

Resulting from Automatic Home Laundering

Referring again to FIG. 1A, the results of the AATCC Test Method 179- for Skewness is shown.

1. Purpose and Scope 1.1 This test method determines change in skewness in woven and knitted fabrics or twist in garments when subjected to repeated automatic laundering procedures commonly use in the home. Washing and drying procedures used for shrinkage tests and other home laundering tests are specified for this method.

1.2 For some fabrics the degree of twist of fabric in garments is not solely dependent on its behavior in the unsewn state; it also may be dependent on the manner of garment assembly.

2. Principle Change in skewness in fabric or twist in garment specimens resulting from procedures typical of home laundering practices is measured using bench marks applied to the specimens before laundering.

Results

A t-shirt made out of black jersey fabric, with a weight of about 6 ounces per square yard, finished tubular, and manufactured according to the present invention was tested after 5 repeated wash/dry/restoration cycles. Skewness and twisting of garments is most apparent at the very bottom of the garment and refers to the way the sides of the garment tend to twist. The results of 0.0 and there is not a better test result possible. (FIG. 1)

General Appearance

Referring again to FIG. 1B, the general appearance is evaluated based on visual observation of the garment after all of the other tests have been conducted.

Results

"Good overall appearance" assessment was given to this t-shirt made of 100% polyester wicking fabric. And was tested after 5 repeated wash/dry/restoration cycles and the pilling test. The results speak for themselves.

AATCC Test Method 124-2001-

Appearance of Fabrics after Repeated Home Laundering

As illustrated in FIG. 1B, the results of the smoothness appearance test are presented.

1. Purpose and Scope 1.1 This test method is designed to evaluate the smoothness appearance of flat fabric specimens after repeated home laundering.

1.2 Any washable fabric may be evaluated for smoothness appearance using this method.

1.3 Fabrics of any construction, such as woven, knit and nonwoven, may be evaluated according to this method.

2. Principle 2.1 Flat fabric specimens are subjected to standard home laundering practices. A choice is provided of hand or machine washing, alternative machine wash cycles and temperatures, and alternative drying procedures. Evaluation is performed using a standard lighting and viewing area by rating the appearance of specimens in comparison with appropriate reference standards.

Results

A t-shirt made out of black jersey fabric, with a weight of about 6 ounces per square yard, finished tubular, and manufactured according to the present invention was tested after 5 repeated wash/dry/restoration cycles. Test results of 4-5, on a scale of 1 to 5 were achieved rating a superior to excellent result. Typically, this fabric demonstrates continuous smoothness, showing almost no wrinkles, even after being rolled up in a ball for weeks at a time. Once shaken and smoothed out, wrinkles virtually disappear.

AATCC Test Method 88B-2003-

Smoothness of Seams in Fabrics after Repeated Home Laundering

Referring again to FIG. 1B, the results of the test checking smoothness of seams are shown.

1. Purpose and Scope 1.1 This test method is designed to evaluate the smoothness appearance of seams in fabrics after repeated home laundering.

1.2 Any washable fabric may be evaluated for seam smoothness using this method.

1.3 Fabrics of any construction, such as woven, knit and nonwoven, may be evaluated according to this method.

1.4 Techniques for seaming are not outlined, since the purpose is to evaluate fabrics as they will be supplied from manufacturing or as ready for use.

2. Principle 2.1 Seamed fabric specimens are subjected to standard home laundering practices. A choice is provided of hand or machine washing, alternative machine wash cycles and temperatures, and alternative drying procedures. Evaluation is performed using a standard lighting and viewing area by rating the appearance of the specimens in comparison with appropriate reference standards.

Results

A t-shirt made out of black jersey fabric, with a weight of about 6 ounces per square yard, finished tubular, and manufactured according to the present invention was tested after 5 repeated wash/dry/restoration cycles. A visual inspection was conducted observing all seams on the garment. A perfect score of 5, based on a scale of 1 to 5, was achieved after 5 commercial wash/dry/restoration cycles.

AATCC Evaluation Procedure 1 (2002)

Gray Scale for Color Change

Referring now to FIG. 1B, the results of the color change test are presented.

1. Scope 1.1 This evaluation procedure describes the use of a Gray Scale for visually evaluating changes in color of textiles resulting from colorfastness tests. For instrumental assessment of change of color of a test specimen refer to AATCC Evaluation Procedure 7. A precise calorimetric specification of the differences between the reference and the 9-Step scale is given as a permanent record against which newly prepared Gray Scales, and old scales that might have changed, can be compared.

Results

A t-shirt made out of black jersey fabric, with a weight of about 6 ounces per square yard, finished tubular, and manufactured according to the present invention was tested after 5 repeated wash/dry/restoration cycles for color change. Test results were a rating of 4-5 on a scale of 1 to 5, on a scale of 1 to 5, showing almost no color change. These results are rated "excellent".

As illustrated in FIG. 3, the same test and evaluation was also conducted on fabric of a different color that was manufactured in accordance with the present invention, and that went through 101 domestic wash cycles at 105 degrees Fahrenheit. The score of this fabric was 4-5, on a scale of 1 to 5, also showing almost no color change. These results are rated "excellent", especially considering the fabric went through over 100 washes. (Diagram III)

ASTM D 3512-02

Standard Test Method for PILLING Resistance and Other Related Surface Changes of Textile Fabrics Random Tumble PILLING Tester As illustrated in FIG. 1B, the results of a test for pilling resistance after five industrial laundering cycles is shown.

1. Scope 1.1 This test method covers the resistance to the formation of pills and other related surface changes on textile fabrics using the random tumble PILLING tester. The procedure is generally applicable to all types of woven and knitted apparel fabrics.

1.2 Some fabrics that have been treated with a silicone resin may not be satisfactorily tested by this procedure because the silicone resin may transfer onto the cork liners in the test chamber and cause erroneous results.

1.3 The values stated in either SI units or inch-pound units are to be regarded separately as the standard. Within the text, the inch-pound units are to be regarded as the standard. Within the text, the inch-pound units are shown in parentheses. The values stated in each system are not exact equivalents; therefore, each system shall be used independently of the other. Combining values from the two systems may result in nonconformance with the specification.

1.4 This standard does not purport to address all of the safety concerns, if any, associated with its use. It is the responsibility of the user of this standard to establish appropriate safety and health practices and determine the applicability of regulatory limitations prior to use.

Results

After undergoing 5 wash/dry/restoration industrial cycles, the t-shirt made of 100% polyester wicking fabric in accordance with the present invention was evaluated for pilling. A score of 4, "slight pilling", was achieved, on a scale of 1 to 5, where 5, "no pilling" is a perfect score.

AATCC Test Method 130-2000

Soil Release: Oily Stain Release Method

As shown in FIG. 4A, the results of the soil release test are illustrated. The test utilized the oily stain method and tested the soil release of a fabric manufactured in accordance with the present invention that was stained with: hamburger grease; mustard; pepperoni grease; pizza sauce; butter sauce; and corn oil.

1. Purpose and Scope 1.1 This test method is designed to measure the ability of fabrics to release oily stains during home laundering.

1.2 This test method is primarily for use by fabric finishers to evaluate the likely performance of soil release finishes in actual use. If this test method is used as part of a contract between buyer and seller, or in any case where comparisons between laboratories are being made, the parties should agree to use the same ballast and detergent. In referee situations, or where standard specifications are involved, 1993 AATCC Standard Reference Detergent should be used.

1.3 The use of this test on garments is not precluded.

2. Principle 2.1 A stain is applied to a test specimen. An amount of the staining substance is forced into the fabric by using a specified weight. The stained fabric is then laundered in a prescribed manner and the residual stain rated on a scale from 5 to 1 by comparison with a stain release replica showing a graduated series of stains.

Results

This 100% polyester yellow jersey fabric with a weight of about 6.3 ounces per square yard, finished open width, and manufactured according to the present invention was washed 101 times and stained with various ingredients that are generally accepted as being some of the most difficult stains to remove in home wash environments: hamburger grease, mustard, pepperoni grease, pizza sauce, butter sauce, and corn oil. Corn oil was not evaluated on the early washes and was added near the end of the test. Fabrics were stained prior to wash, and again at 25, 50, 75, and at 101 washes. The hamburger and pepperoni grease were obtained by cooking these ingredients in the laboratory. The grease was then applied to the fabric by rubbing the grease into the fabric. A 5 represents the best stain removal, and a 1 the poorest stain removal. A rating of 4.5 on each all the stains at 101 washes is phenomenal. Most fabrics lose their satin release ability by 25 or 30 washes. The pepperoni, pizza sauce, and butter sauce were obtained from Domino's Pizza. Please note that the normal staining agent for this test is corn oil or vegetable oil. We believe the stains we chose to test are some of the most difficult common stains, and the test results demonstrate stain and soil release results not previously recorded at 25 washes, and certainly never recorded at 50, 75 or 100 washes.

FIGS. 4B, 4C and 4D are reports of the same test as above (AATCC Test Method 130-2000) with some slightly different staining agents, and conducted on a light orange double knit fabric with a weight of about 5.9 ounces per square yard, finished open width, and manufactured according to the present invention (FIG. 4B), conducted on a white woven fabric with a weight of about 8.1 ounces per square yard, finished open width, and manufactured according to the present invention (FIG. 4C), and a yellow 3-end fleece knit fabric with a weight of about 10.75 ounces per square yard, finished open width and manufactured according to the present invention (FIG. 4D).

Hamburger and pepperoni were cooked at the lab to obtain grease for each test, used cooking oil from a fryer was used as another staining agent, as was coffee and pizza sauce. At 50 washes, each fabric received a perfect score of 5 out of 5, for each stain, and each stain completely washed out of the fabric with warm water and a mild detergent. At the time of this application, only 50 washes had been completed out of 101 planned washes. To date, there are no known fabrics having comparable test results at 50 or more washes, nor are there any known fabric tests with similar stain agents.

AATCC Test Method 183-2004

Transmittance or Blocking of Erythemally Weighted Ultraviolet Radiation through Fabrics The results of the ultraviolet tests are presented in FIGS. 5A, 5B, 5C, 5D, 5E, 6A, 6B and 7.

1. Purpose and Scope 1.1 This standard test method is used to determine the ultraviolet radiation blocked or transmitted by textile fabrics intended to be used for UV protection.

2. Principle 2.1 The transmission of ultraviolet radiation (UV-R) through a specimen is measured on a spectrophotometer or spectroradiometer at known wavelength intervals.

2.1.1 The ultraviolet protection factor (UPF) is computed as the ratio of the erythemally weighted ultraviolet radiation (UV-R) irradiance at the detector with no specimen to the erythemally weighted UV-R irradiance at the detector with a specimen present.

2.1.2 The erythemally weighted UV-R irradiance at the detector with no specimen present is equal to the summation between wavelength intervals of the measured spectral irradiance times the relative spectral effectiveness for the relevant erythemal action spectra times the UV-R weighting function of the appropriate solar radiation spectrum times the appropriate wavelength interval.

2.1.3 The erythemally weighted UV-R irradiance at the detector with a specimen present is equal to the summation between wavelength intervals of the measured spectral irradiance times the relative spectral effectiveness for the relevant erythemal action spectrum times the spectral transmittance for the specimen times the wavelength interval.

2.1.4 The percent blocking of UVA and UVB radiation is also calculated.

Results

This test evaluates the ability of a fabric to block the invisible UVA and UVB rays that are harmful to the skin. The test averages the readings of the blockage and a score is given in terms of a UPF number. UPF stands for Ultraviolet Protection Factor. For the FTC to allow a rating on articles of apparel, or in advertising, this test and evaluation must first be done.

UPF Rating 40-50+Excellent UV protection 97.5%-98.0%

25-35 Very Good UV protection 96.0%-97.4%

15-20 Good UV protection 93.3%-95.8%

A minimum of rating of 15 is required to for UPF labeling on articles of apparel or in advertising. A rating of UPF 50+ is the highest rating allowable, and blocks a minimum of 98% of al UV rays. The chart above shows the percent of UV rays blocked. A 1 over the UPF number demonstrates the maximum amount of UV rays coming through the fabric. A UPF 15 rating allows 1/15 of UV rays through the fabric. A UPF rating of 50+ allows 1/50 of the UV rays through the fabric.

FIG. 5A presents the results for orange and yellow jersey fabric made in accordance with the present invention. Orange 100% polyester wicking jersey fabric with a weight of 6.4 ounces per square yard and finished tubular, made in accordance with the present invention was tested and received the highest rating possible, UPF 50+, and yellow 100% polyester wicking jersey fabric, with a weight of 6.3 ounces per square yard and finished tubular, made in accordance with the present invention received the second highest rating possible of UPF 45+. Both results receive a rating of "Excellent UV Protection." These results are very unusual for a jersey fabric of this weight.

FIG. 5B shows a white jersey fabric with a weight of 5.5 ounces per square yard, finished open width, and made in accordance with the present invention. This test is identical to FIG. 5A, plus the fabric was also tested after 25 and 50 washes. This fabric meets FTC regulations for UV protective clothing, and it even improves after 25 and 50 washes.

FIG. 5C shows a white jersey fabric with a weight of 6.4 ounces per square yard, finished open width, and made in accordance with the present invention. With an approximate 15% increase in total fabric weight compared to the fabric of FIG. 5B, the UV protection exactly double in the "As Received" column, and improves from a rating of UPF30+ to UPF40+ after 25 washes. At 50 washes, although the UPF rating drops to UPF35+, please note that the actual rating at 50 washes is 39.42. However, standard practice is to round the test result rating downward to the nearest multiple of five to determine the UPF number. In this case 39.42 is very nearly 40. The number must always be rounded down to the nearest 5.

FIG. 5D shows a white jersey fabric with a weight of 7.4 ounces per square yard, finished open width, and made in accordance with the present invention. Even though this fabric is white and made of jersey, it received the highest rating of UPF50+, which is rated as "Excellent" protection. This fabric was also washed 25 and 50 times and demonstrated increased UV protection. It is known that fabrics that are wet perform poorly in UV tests. However, since our white jersey fabric received the highest rating possible of UPF50+ in "As Received", after 25 washes and after 50 washes, we tested it in its wet state. The tested fabric still maintained a UPF50+ rating when wet "As Received", after 25 washes and after 50 washes.

FIG. 5E shows a white jersey fabric with a weight of 6.1 ounces per square yard, finished tubular, and made in accordance with the present invention. Although its initial "As Received" rating was a very good UPF35+, after 25 and 50 washes it improved and received scores of UPF50+.

FIG. 5A through FIG. 5E clearly show that fabrics made in accordance with the present invention, with a weight in the 6 ounces per square yard to 7.4 ounces per square yard range demonstrate the highest degree of UV protection. According to the test results, the protection increases when washed 25 times or more, T-shirts with this level of UV protection are not currently known in the industry, and certainly not in white.

FIG. 6A shows a light orange double knit fabric with a weight of 5.9 ounces per square yard, finished open width, and made in accordance with the present invention. Again, after repeated washes, UPF numbers increase.

FIG. 6B shows a white woven fabric with a weight of 8.1 ounces per square yard, finished open width, and made in accordance with the present invention. Again, protection increases after repeated washes, and the level of protection in this fabric is phenomenal with an average of over 99% of all UV rays blocked.

As one skilled in the art can appreciate, it is common for various colors of the identical fabric to have different UPF ratings. Different dyes and heavier concentrations of the same dye will affect the UV blockage characteristics of the fabric. But it is important to note that white is regarded as the color having the poorest UPF rating.

Referring now to FIG. 7 shows a white jersey fabric with a weight of 5.9 ounces per square yard, finished tubular, and made in accordance with the present invention. This comparison shows before and after, how a white fabric's UV protection will increase after a sublimation print is applied to it. These two UV tests were conducted before and after on the same white 100% polyester wicking fabric. The white fabric had a dye sublimation heat transfer image applied to it. The application procedure was 400 degrees Fahrenheit, heated for thirty seconds at 45 psi. The fabric had an irregular camouflage image transferred into it. This fabric image was then tested for its UV protection. An actual UPF reading of 18.3 was achieved with a UPF rating of 15. This result was higher than the 17.82 actual score the other white fabric received that had no image transferred into it. This demonstrates that dye sublimation heat transfer applications of dye images onto fabrics can increase UV protection.

AATCC Test Method 61-2003-2A

Colorfastness to Laundering, Home and Commercial: Accelerated (FIG. 8)

Referring now to FIG. 8, the results of a fabric printed with a camouflage pattern is tested for color fastness are shown.

1. Purpose and Scope 1.1 These accelerated laundering tests are to evaluate the colorfastness to laundering of textiles which are expected to withstand frequent laundering. The fabric color loss and surface changes resulting from detergent solution and abrasive action of five typical hand, home or commercial launderings, with or without chlorine, are roughly approximated by one 45 min test.

2. Principle 2.1 Specimens are tested under appropriate conditions of temperature, detergent solution, bleaching and abrasive action such that the color change is similar to that occurring in five hand, home or commercial launderings.

Results

FIG. 8 shows a white jersey fabric with a weight of 5.9 ounces per square yard, finished tubular, and made in accordance with the present invention, with a dye sublimation heat transfer image applied to it. The application procedure was 390 degrees Fahrenheit, heated for 30 seconds at 60 psi. The fabric was then tested for the colorfastness of the dyed image that was applied to it. After 5 washings in warn water with detergents and abrasive action, the colorfastness of the dye is evaluated. In this test, a rating of 5 was achieved, on a scale of 1 to 5, where 5 represents the highest possible colorfastness rating. As one skilled in the art would recognize, this fabric achieved an exceptional score.

AATCC Test Method 8-2004

Colorfastness to Crocking: AATCC Crockmeter Method (FIG. 9)

The test results for a white fabric printed with dye sublimation heat transfer application (shark pattern) are presented in FIG. 9.

1. Purpose and Scope 1.1 This test method is designed to determine the amount of color transferred from the surface of colored textile materials to other surfaces by rubbing. It is applicable to textiles made from all fibers in the form of yarn or fabric whether dyed, printed or otherwise colored. It is not recommended for use for carpets or for prints where the singling out of areas may be too small using this method.

1.2 Test procedures employing white test cloth squares, both dry and wet with water, are given.

1.3 As washing, drycleaning, shrinkage, ironing, finishing, etc., may affect the degree of color transfer from a material, the test may be made before, after, or before and after such treatment.

2. Principle 2.1 A colored test specimen is rubbed with white crock test cloth under controlled conditions.

2.2 Color transferred to the white test cloth is assessed by a comparison with the Gray Scale for Staining or the Chromatic Transference Scale and a grade is assigned.

Results

FIG. 9 shows a white jersey fabric with a weight of 5.9 ounces per square yard, finished tubular, and made in accordance with the present invention, having had a dye sublimation heat transfer image applied to it. The application procedure was 390 degrees Fahrenheit, heated for 30 seconds at 60 psi. The image on the fabric was then evaluated for crocking, or the amount of dye that is transferred using a rubbing method to a receptive fabric, while the fabric is dry, and then again while the fabric is wet. The results were a 5, on a scale of 1 to 5, where a 5 represents "no staining", or the highest score possible.

ASTM E 96-00e1

Standard Test Methods for Water Vapor Transmission of Materials

Referring to FIG. 10, the results of a white fabric with dye sublimation heat transfer application (shark pattern) is shown.

1. Scope 1.1 These test methods cover the determination of water vapor transmission (WVT) of materials through which the passage of water vapor may be of importance, such as paper, plastic films, other sheet materials, fiberboards, gypsum and plaster products, wood products, and plastics. The test methods are limited to specimens not over 1¼ in. (32 mm) in thickness except as provided in Section 9. Two basic methods, the Desiccant Method and the Water Method, are provided for the measurement of permeance, and two variations include service conditions with one side wetted and service conditions with low humidity on one side and high humidity on the other. Agreement should not be expected between results obtained by different methods. That method should be selected which more nearly approaches the conditions of use.

1.2 The values stated in inch-pound units are to be regarded as the standard. Metric inch-pound conversion factors for WVT, permeance, and permeability are known to people skilled in the art. All conversions of mm Hg to Pa are made at a temperature of 0° C. This standard does not purport to address all of the safety problems, if any, associated with its use. It is the responsibility of the user of this standard to establish appropriate safety and health practices and determine the applicability of regulatory limitations prior to use.

Results

FIG. 10 shows a white jersey fabric with a weight of 5.9 ounces per square yard, finished tubular, and made in accordance with the present invention, having had a dye sublimation heat transfer image applied to it. The application procedure was 390 degrees Fahrenheit, heated for 30 seconds at 60 psi. This fabric with the image on it was evaluated for its ability to have moisture pass through it. Three pieces of fabric are each placed over 3 beakers with measured amounts of water in them. These beakers are then placed in a chamber with a fan in it causing a continuous flow of air to pass over the beakers. After twenty-four hours, the water in the beakers is measured and a rate of moisture transmission is determined. Even after going through the highly stressful dye sublimation heat transfer application process, the fabric made in accordance with the present application rated "excellent" in its ability to let moisture pass through it.

AATCC TEST METHOD 79-2000

(FIG. 11)

Absorbency of Textiles

1. Purpose and Scope 1.1 Absorbency is one of several factors that determine the suitability of a fabric for a particular use.

2. Principle 2.1 A drop of water is allowed to fall from a fixed height onto the taut surface of a test specimen. The time required for the specular reflection of the water drop is measured and recorded in wetting time.

A drop of distilled water was dropped onto the fabric from a height of 1". A stopwatch was used to measure the time it took the drop of water to be completely absorbed by the fabric, also known as no specular reflection. The test was stopped at 5.0 seconds or at the point where the surface of the liquid loses its specular reflection. An average of 3 readings were recorded. Averages of less than 0.5 seconds were recorded as 0.0 seconds.

Results

Another way to test the wicking or absorption of fabrics is with the above test. Comparisons can be drawn from one fabric to another. A total of eight fabrics manufactured according to the present invention were testing using this method. There were five different kinds of fabrics totaling eight different weights. Seven fabrics were tested "As Received" and seven fabrics were tested after 50 washes. Only all fabrics received a perfect score of 0.00 seconds for water absorption, and the remaining fabrics received scores of less than one second.

Referring now to FIG. 12A, the wicking ability of a yellow jersey fabric weighing about 6.3 ounces per square yard, finished open width, and manufactured according to the present invention is set forth in objective terms. FIG. 12A demonstrates that this jersey fabric's wicking ability is still present, and actually improves slightly after 101 domestic wash and dry cycles. This test demonstrates the permanence of the fabric's ability to wick. The wicking test was conducted using 5 strips of fabric cut in the vertical direction, and 5 strips of fabric cut in the horizontal direction. The fabric is hung vertically and then slightly immersed in water. This is a gravity test method measuring the length of time it takes water to travel 3" p the fabric. The time was recorded on the 10 different strips of fabric and recorded at the intervals listed. A smaller number represents a faster rate of wicking. These strips of fabric had been laundered and dried according to AATCC Method 135 (3)IIIA(iii), Permanent Press Laundering Cycle 105 degrees F., Tumble Dry Permanent Press.

FIG. 12B represent the identical test conducted on a white jersey fabric weighing about 6.1 ounces per square yard, finished tubular and manufactured according to the present invention. This test was only run through 50 washes at the time of this application, but will continue through 101 washes. The results show an improvement in wicking over repeated washes, and better results than the fabric used in FIG. 12A.

FIG. 12C is the report of the identical test run on a white jersey fabric weighing about 7.2 ounces per square yard, finished open width and manufactured according to the present invention. As with the previous tests, this fabric demonstrates an increase in wicking ability over repeated washes. This test was only run through 50 washes at the time of this application, but will continue through 101 washes.

FIG. 12D is the report of the identical test run on a white woven fabric, finished open width, weighing 8.1 ounces per square yard and manufactured according to the present invention. As with the previous tests, this fabric demonstrates an increase in wicking ability over repeated washes. This test was only run through 50 washes at the time of this application, but will continue through 101 washes.

FIG. 12E is the report of the identical test run on a yellow 3-end fleece fabric, finished open width, weighing 10.15 ounces per square yard and manufactured according to the present invention. As with all of the previous tests, this fabric demonstrates an increase in wicking ability over repeated washes. And the overall times at 25 and 50 washes is quite exceptional as compared with the reported times on the other tests. This test was only run through 50 washes at the time of this application, but will continue through 101 washes.

The reports of FIGS. 12A through 12E shows that many different kinds and weights of fabric manufactured according to the present invention, all demonstrate long-lasting wicking ability after 50 and 101 washes.

The present invention discloses a method of making a synthetic-rich fabric having improved print and dye receptive qualities, stain and soil release qualities, and UV protection qualities. It is to be realized that optimum dimensional relationships for the parts of the invention to include variations and size, materials, shape, form, function and manner of operation, assembly and use are deemed readily apparent and obvious to one skilled in the art. All equivalent relationships to those illustrated in the drawings and described in the specification are intended to be encompassed herein. The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the present invention and are deemed within the present inventive concept.

The invention claimed is:

1. A process for making a fabric, wherein said process comprises the steps of:

(a) selecting a 100% polyester yarn;

(b) making said polyester yarn into a sheet of tightly constructed fabric so as not to disturb the face of said fabric; and (c) chemically, physically and thermally treating said fabric by scouring said fabric formed from said polyester yarn in a jet-dyeing machine, and treating said fabric formed from said polyester yarn with a polymeric/surfactant wicking agent and, optionally, with one or more lubricants, hydrophilic softeners and/or dyes;

wherein said chemical, physical and thermal treatment (c) of said fabric causes said fabric to exhibit a soil release rating of about 4.5 or greater after 100 washes; and wherein said fabric consists of said polyester yarn, said polymeric/surfactant wicking agent and optionally said one or more fabric lubricants, hydrophilic fabric softeners and/or fabric dyes wherein said scouring of step (c) comprises the steps of:

i) filling said jet dyeing machine to load volume with water heated to approximately 100° F.;

ii) adding defoamer to said 100° F. water to form a water/defoamer mixture;

iii) loading the fabric into said water/defoamer mixture in said jet dyeing machine;

iv) adding scour agent to said water/defoamer mixture;

v) circulating said water/defoamer mixture for about four minutes;

vi) adding a Polymeric/Surfactant blend to said water/defoamer mixture;

vii) running said jet dyeing machine for about two minutes;

viii) increasing the temperature of said mixture by about 3° F. per minute until the temperature of said mixture reaches approximately 180° F.;

ix) circulating said mixture for about 5 minutes at approximately 180° F.;

x) raising the temperature of said mixture by about 2° F. per minute until the mixture reaches a temperature of approximately 265° F.;

xi) holding the temperature of said mixture at approximately 265° F. for about thirty minutes;

xii) reducing the temperature of said mixture at an approximate rate of 2° F. per minute until it reaches approximately 140° F.;

xiii) using an overflow wash of 100° F. water, reducing the temperature of the mixture to approximately 100° F. over about 10 minutes;

xiv) draining said mixture from said jet dyeing machine;

xv) filling said jet dyeing machine to volume with water heated to about 100° F.;

xvi) overflow washing with said jet dyeing machine for about 10 minutes using approximately 100° F. water;

xvii) checking the pH of the water bath to make sure it is within specified range for fabric type;

xviii) unloading fabric; and xix) draining said jet dyeing machine.

2. A process for making a fabric, wherein said process comprises the steps of:

(a) selecting a 100% polyester yarn;

(b) making said polyester yarn into a sheet of tightly constructed fabric so as not to disturb the face of said fabric; and (c) chemically, physically and thermally treating said fabric by scouring said fabric formed from said polyester yarn in a jet-dyeing machine, and treating said fabric formed from said polyester yarn with a polymeric/surfactant wicking agent and, optionally, with one or more lubricants, hydrophilic softeners and/or dyes;

wherein said chemical, physical and thermal treatment (c) of said fabric causes said fabric to exhibit a soil release rating of about 4.5 or greater after 100 washes; and wherein said fabric consists of said polyester yarn, said polymeric/surfactant wicking agent and optionally said one or more fabric lubricants, hydrophilic fabric softeners and/or fabric dyes; and wherein said step (c) of chemically, physically and thermally treating said fabric includes the steps of:

I) scouring said fabric to remove lubricants which remained from the yarn production and knitting processes; and II) jet dyeing said fabric in a jet dyeing machine, wherein said dyeing step comprises the steps of:

i) filling said jet dyeing machine to load volume with water heated to approximately 100° F.;

ii) adding defoamer to said 100° F. water to form a water/defoamer mixture;

iii) loading the fabric into said water/defoamer mixture in said jet dyeing machine;

iv) adding Acetic Acid, hydrophilic softener and any dye combination necessary to achieve desired color to said water/defoamer mixture;

v) circulating said water/defoamer mixture for about five minutes;

vi) adding a Polymeric/Surfactant blend to water/defoamer mixture;

vii) running said jet dye machine for about two minutes;

viii) increasing the temperature of said mixture by about 4° F. per minute until the temperature of said mixture reaches approximately 265° F.;

ix) holding the temperature of said mixture at approximately 265° F. for about thirty minutes;

x) reducing the temperature of said mixture at an approximate rate of 2° F. per minute until it reaches approximately 170° F.;

xi) checking shade of fabric to ensure it matches standard;

xii) adding an excess dye removal agent to the mixture;

xiii) draining said mixture from said jet dyeing machine;

xiv) filling said jet dyeing machine to volume with water heated to about 120° F.;

xv) overflow washing with said jet dye machine for about ten minutes using approximately 100° F. water;

xvi) draining said mixture from said jet dyeing machine;

xvii) filling said jet dye machine to volume with water heated to about 80° F.;

xviii) running said jet dyeing machine for approximately five minutes;

xix) checking the pH of the water bath to make sure it is within specified range for fabric type;

xx) checking shade of fabric a second time to ensure it matches standard;

xxi) unloading fabric; and xxii) draining said jet dyeing machine.

3. The process of claim 1 or claim 2, wherein said polyester yarn is ring spun yarn.

4. The process of claim 1 or claim 2, wherein said polyester yarn is open ended.

5. The process of claim 1 or claim 2, wherein said polyester is air jet spun.

6. The process of claim 1 or claim 2, wherein the step of making the yarn into a fabric includes knitting.

7. The process of claim 6 wherein said fabric is a single-knit jersey fabric in which said yarn is a 20 count/single ply (20/1) yarn and has a finished weight of between approximately 5.4 and 7.5 oz. per square yard.

8. The process of claim 7 wherein said finished weight is exactly 7.4 and said jersey fabric provides UV protection, and has an Ultraviolet Protection Factor (UPF) label rating of 50 after 25 washings.

9. The process of claim 7 wherein the UV protection provided by the fabric is increased by tightening the knit to thereby increase the finished weight.

10. The process of claim 1 or claim 2, wherein the step of making the yarn into a fabric includes weaving.

11. The process of claim 10 wherein said fabric is a woven fabric in which the yarn is a 16 count/single ply (16/1) yarn and has a denier of approximately 1.2.

12. The process of claim 5 wherein said fabric is a fleece in which the yarn is an air jet 16 count/single ply (16/1) yarn.

13. The process of claim 4 wherein said fabric is a fleece in which the yarn is an open ended 10 to 30 count/single ply (10/1-30/1) yarn.

14. A fabric produced by the process of claim 1 or claim 2.

15. A garment made from the fabric of claim 14.

16. A non-apparel item made from the fabric of claim 14.

17. The non-apparel item of claim 16, wherein said item is a pillowcase, bed sheet, table cloth, or napkin.

* * * * *